US005740934A

United States Patent [19]

Brady

[11] Patent Number: 5,740,934

[45] Date of Patent: Apr. 21, 1998

[54] CONTAINER WITH VERTICAL STIFFENING IN CENTRAL PANEL

[75] Inventor: Thomas E. Brady, Sylvania, Ohio

[73] Assignee: Plastic Technologies, Inc., Holland, Ohio

[21] Appl. No.: 814,795

[22] Filed: Mar. 10, 1997

Related U.S. Application Data

[63] Continuation of Ser. No. 529,744, Sep. 18, 1995.

[51] Int. Cl.[6] ..... B65D 1/44

[52] U.S. Cl. ..... 215/381; 215/375; 215/382; 220/671; 220/675

[58] Field of Search ..... 215/371, 372, 215/373, 374, 375, 381, 382; 220/669, 671, 672, 673, 675; D9/548, 559, 550, 556, 375

[56] References Cited

U.S. PATENT DOCUMENTS 5,303,834 4/1994 Krishnakumar et al. .

*Primary Examiner*—Stephen J. Castellano
*Attorney, Agent, or Firm*—Donald R. Fraser

[57] ABSTRACT

An improved plastic container of the type suitable for containing carbonated beverages. The container is provided with a central section, an upper section including a typically threaded neck portion, and a lower end or base section typically including radially arrayed concave foot portions to support the container in an upright position. The horizontal cross-section of the central section manifests the configuration thereof to include a plurality of juxtaposed generally flat panels which upon pressurization of the container tend to blend together to form a circular cross-sectional configuration.

8 Claims, 4 Drawing Sheets

CONTAINER WITH VERTICAL STIFFENING IN CENTRAL PANEL

This application is a continuation of application Ser. No. 08/529,744, filed Sep. 18, 1995, (pending).

BACKGROUND OF THE INVENTION

The invention relates to a plastic container and more particularly, to an improved plastic container structure of the type suitable for containing carbonated beverages.

The bottling of carbonated beverages in plastic containers presents a number of problems, many of which arise in connection with the structure of the central portion of the container, particularly when the overall plastic content is decreased in weight. Mere plastic duplication of the traditional glass bottle design configuration is deemed unsatisfactory for a myriad of reasons, one of which is the tendency of the resultant container to feel somewhat flimsy in the hand of the ultimate user. Also, mere duplications in plastic sometimes are unsatisfactory due to the fact that plastic materials have a tendency to creep or become otherwise distorted when the containers are filled with carbonated beverages or other fluids under pressure. Such distortion may alter the shape and dimensions of the container configuration which tends to adversely affect the application of indicia containing outer wraps and result in a distortion of the wrap and integral indicia.

The above noted problems can threaten customer acceptance or satisfaction of the product within the container.

A plastic container, when filled with a carbonated beverage and capped, must be able to withstand the impact of falling from at least a moderate height and must be dimensional stable in respect of the outer shape and dimensions to enable the container to be of the same capacity as glass containers so that they may be handled or processed by existing equipment and assist in customers' identification of the particular product contained therein. Aesthetic appearance is typically a given requirement.

Also, when the plastic container becomes distorted by the internal pressure, it may become unstable on a horizontal surface. Such instability may result in a probability of an adverse customer reaction toward the container contents.

The prior art is replete with disclosures of plastic container structures illustrating and describing improved bottom structures for plastic containers of the type suitable for containing carbonated or effervescent beverages.

However, the aspects of the side wall configuration have only relatively recently attracted attention primarily due to the desideratum on the part of beverage bottlers to reduce the overall weight of the plastic material required to form the container. Also, with the advent of the use of plastic sheet overlays on the container, it has become necessary to direct considerable attention to the dimensional stability aspects of the central section of the container adapted to support the overlay.

SUMMARY OF THE INVENTION

In accordance with the present invention, an improved plastic container of the type suitable for carbonated beverages, for example, has been developed. Such new container contains a central section having a portion thereof which tends to change or vary at least in the outermost configuration as a result of internal pressurization, typically due to the presence of a carbonated beverage. More specifically, the portion is caused to assume or approach a circular cylindrical shape upon pressurization and thence will return to its original shape upon depressurization due to the memory of the plastic material forming the container wall.

More objects, features, and advantages of the invention will become readily manifest to those skilled in the art from reading the following detailed description of a preferred embodiment of the invention, when considered in the light of the accompanying drawings, in which:

DETAILED DESCRIPTION OF THE PREFERRED EMBODIMENTS

Figure 1:
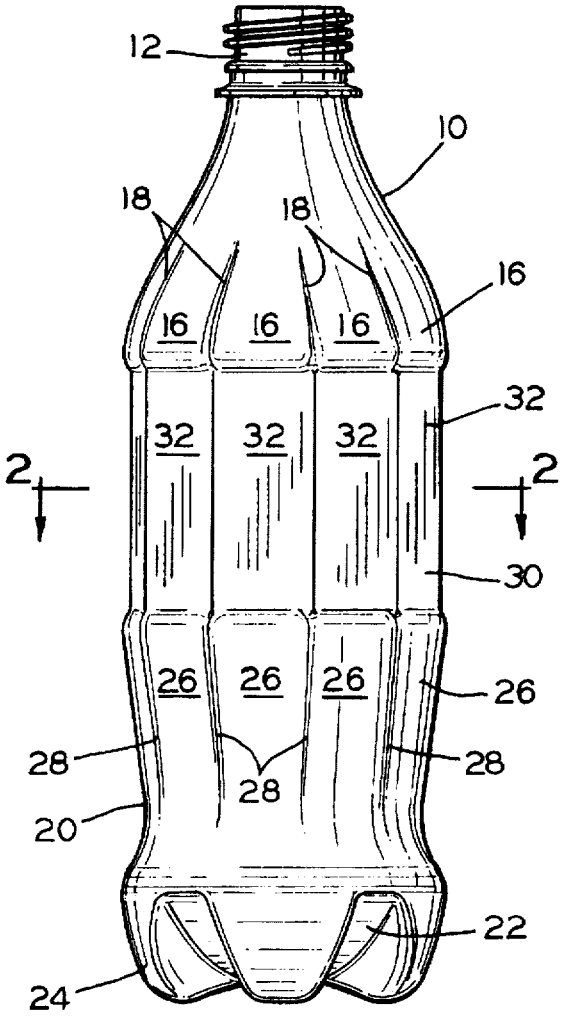
FIG. 1 is an elevational view of a container having a central section constructed in accordance with the invention.

Referring to the drawings, there is illustrated a plastic container constructed generally in accordance with the teachings of the invention and is preferably formed of a thermoplastic material having gas barrier properties to such a degree that the container will be suitable for containing a carbonated beverage at least throughout the expected shelf-life which typically is the period from the bottling of the beverage to consumption. A number of materials having the above properties have been developed. A preferred material for forming the container of the invention is a polyethylene terephthalate (PET) product by Shell Oil Company under No. 8006 and having an intrinsic viscosity of 0.80.

The container is typically blow-molded from an extruded or injection molded preform or parison and has preferably been so worked that the material is biaxially oriented.

Figure 3:
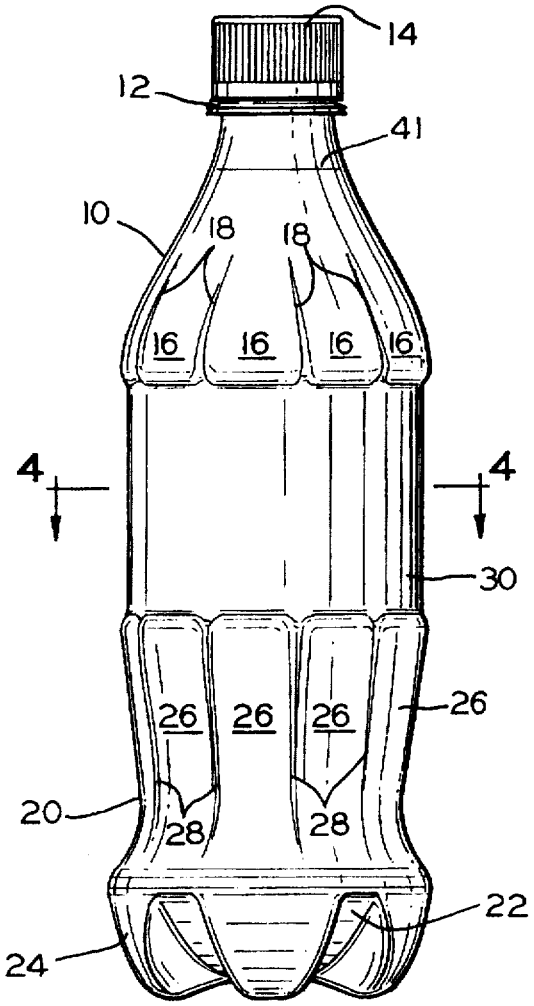
FIG. 3 is an elevational view of the container of FIGS. 1 and 2 illustrating the configuration of the central section after the container has been filled with a pressurized fluid and capped.

The container typically includes an upper section 10, a base section 20, and a central section 30. The upper section 10 is provided with neck portion 12 having any desired neck finish such as the threaded finish shown. The threaded neck portion 12 is adapted to receive an internally threaded closure member 14 as illustrated in FIG. 3. It will further be noted that the upper section 10 is formed to contain a plurality of parallel flutes 16 separated by valleys or grooves 18.

The base section 20 has an outer surface 22 provided with generally radially arranged contoured foot portions 24. The foot portions 24 extend outwardly and are illustrated as preferably being five (5) in number. The number of foot portions 24 is not deemed to be critical and may be as low as three, the minimum number required to provide stable support on a planar surface, and the maximum number is limited only by the overall dimensions and wall thickness of the base section 20. The base section 20 is formed to contain a plurality of parallel flutes 26 separated by valleys or grooves 28.

The central section 30 is formed of a plurality of juxtaposed flat panels 32 and interconnects the upper section 10 and the base section 20. It will be noted that at the juncture of the lower end of the upper section 12 and the upper end of the central section 30, there is an inwardly formed step caused by the reduced diameter of the central section 30. A similar inwardly formed step is formed at the juncture of the upper end of the base section 20 and the lower end of the central section 30.

An annular outwardly extending portion 38 is formed in the base section 20 intermediate the lower termination of the flutes 26 and associated valleys 28, and the upper termination of the foot portions 24.

The flutes 16, 26 and the associated valleys 18, 28 respectively, are deemed to be functional as well as aesthetic. More specifically, the valleys 18, 28 provide necessary conduits of moisture formed from condensate leaving the flutes 16, 26 somewhat free from moisture when grasped by the hand of a person handling the container.

Additionally, the flutes 16, 26, the valleys 18, 28, and the flat panels 32 cooperate to lend rigidity, and stiffness to the container, particularly in the unpressurized condition. Thereby, the hand of the ultimate user is left with a pleasing and comfortable reaction towards the container and its contents.

Figure 2:
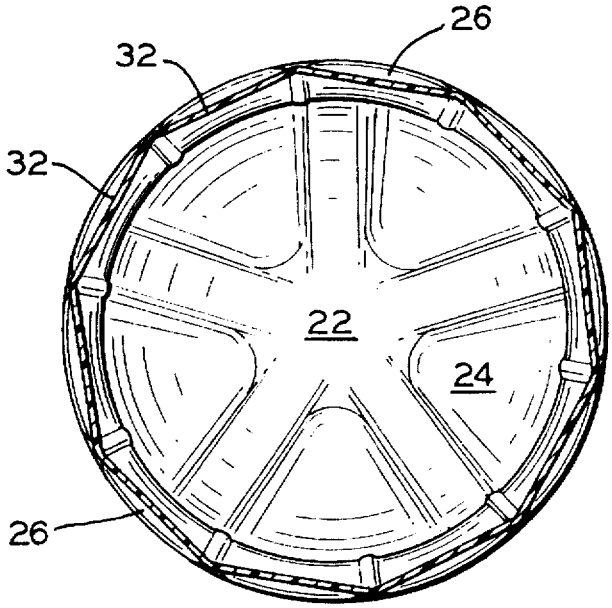
FIG. 2 is a cross-sectional view of the container illustrated in FIG. 1 taken along line 2—2 thereof.
Figure 4:
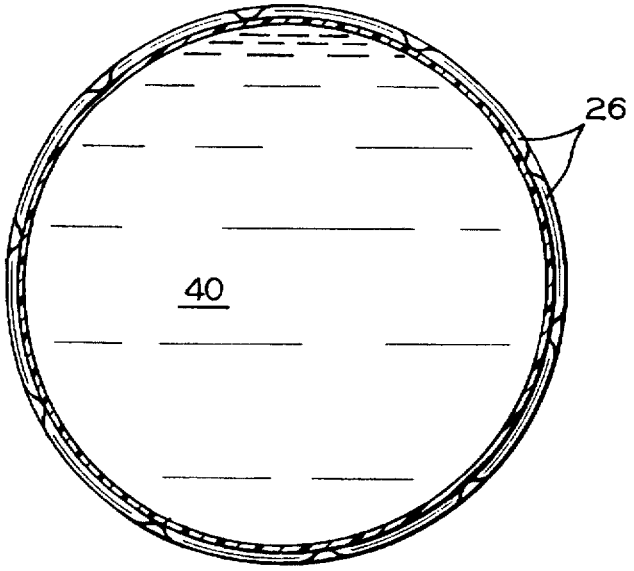
FIG. 4 is a cross-sectional view of the container illustrated in FIG. 3 taken along line 4—4 thereof.

FIGS. 3 and 4 illustrate the container of FIGS. 1 and 2 after it has been filled with a pressurized fluid such as, for example, a carbonated beverage generally indicated by the reference numeral 40. The pressurized fluid 40 is typically filled to a fill line 41.

Upon pressurization of the container, the center section 30 tends to assume a right cylindrical shape as is readily apparent from viewing FIG. 4. The flat panels 32 of the unpressurized container as illustrated clearly in FIG. 2, assume a curved cross-section and the decidedly angular configuration between the panels 32 tends to disappear again as illustrated in FIG. 4.

The relative smoothness of the center section 30 in the pressurized condition is of particular advantage from an identification standpoint. The trademark and contents of the internal beverage may now be applied to a separate plastic film overlay or overwrap. Due to the substantially uninterrupted exterior of the central section 30 in the pressurized state of the container, the associated film containing the printed indicia, is likewise unfettered with wrinkles or other irregularities which otherwise would adversely affect the appearance of the trademark and other recognition and advertising indicia thereon. The resultant appearance is pleasing to the ultimate consumer achieving one of the important sales objectives of the bottler of the carbonated beverage.

When the ultimate user finally loosens the closure 14 allowing the container to assume the unpressurized state, the container assumes the condition and physical configuration of FIGS. 1 and 2. It is in such unpressurized condition that the container returns to the more rigid condition.

An embodiment of the container illustrated in FIGS. 1 to 4 is illustrated in FIGS. 5 to 8. In describing the embodiment, prime reference numerals will be used to designate features similar to those contained in the container of FIGS. 1–4.

Figure 7:
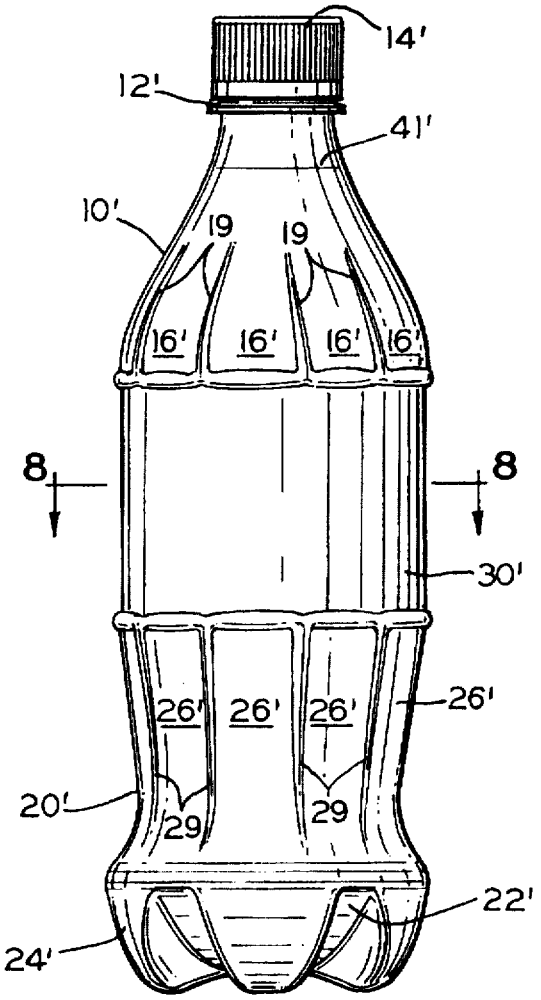
FIG. 7 is an elevational view of the container of FIGS. 5 and 6 illustrating the configuration of the central section after the container has been filled with a pressurized fluid and capped.

The container typically includes an upper section 10', a base section 20', and a central section 30'. The upper section 10' is provided with neck portion 12' having any desired neck finish such as the threaded finish shown. The threaded neck portion 12' is adapted to receive an internally threaded closure member 14' as illustrated in FIG. 7. It will further be noted that the upper section 10' is formed to contain a plurality of parallel flutes 16' separated by outwardly extending ribs 19.

The base section 20' has an outer surface 22' provided with generally radially arranged contoured foot portions 24'. The foot portions 24' extend outwardly and are illustrated as preferably being five (5) in number. The number of foot portions 24' is not deemed to be critical and may be as low as three, the minimum number required to provide stable support on a planar surface, and the maximum number is limited only by the overall dimensions and wall thickness of the base section 20'. The base section 20' is formed to contain a plurality of parallel flutes 26' separated by outwardly extending ribs 29.

The central section 30' is formed of a plurality of juxtaposed flat panels 32' and interconnects the upper section 10' and the base section 20'. A bead or rib 34 is formed at the juncture of the lower end of the upper section 12' and the upper end of the central section 30'. A similar bead or rib 36 is formed at the juncture of the upper end of the base section 20' and the lower end of the central section 30'. The preferred geometry of the container dictates that the diameter of the beads 34 and 36 are substantially equal.

An annular bead or rib 38 is formed in the base section 20' intermediate the lower termination of the flutes 26' and associated ribs 29, and the upper termination of the foot portions 24.

Additionally, the flutes 16', 26', the ribs 19, 29, and the flat panels 32, and the beads 34 and 36 cooperate to lend rigidity, and stiffness to the container, particularly in the unpressurized condition. Thereby, the hand of the ultimate user is left with a pleasing and comfortable reaction towards the container and its contents.

Figure 5:
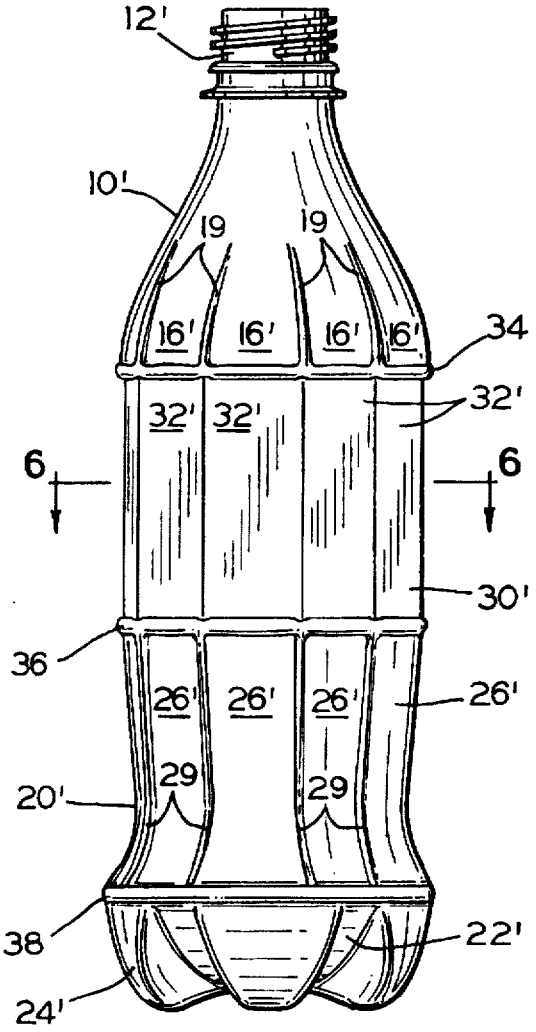
FIG. 5 is an elevational view of an alternative embodiment of the container illustrated in FIGS. 1 to 4 having a central section constructed embodying the features of the invention.
Figure 6:
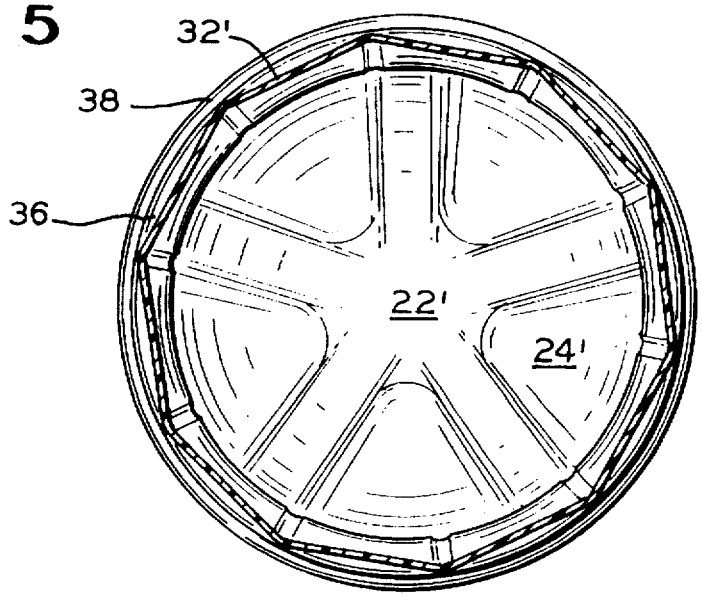
FIG. 6 is a cross-sectional view of the container illustrated in FIG. 5 taken along line 6—6 thereof.
Figure 8:
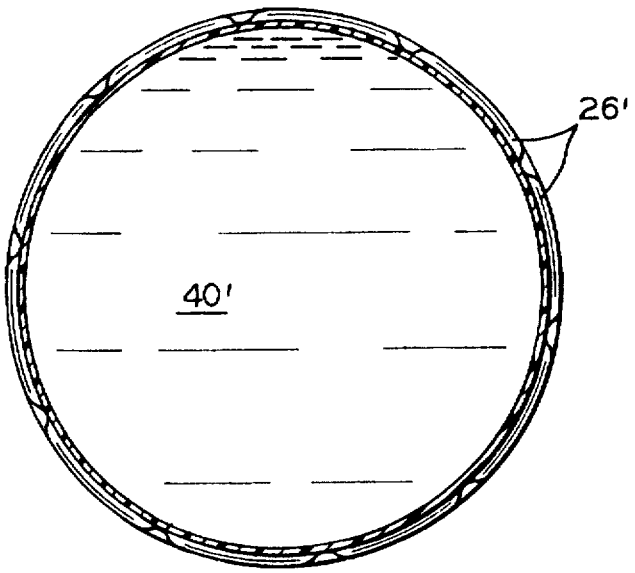
FIG. 8 is a cross-sectional view of the container illustrated in FIG. 7 taken along line 8—8 thereof.

FIGS. 7 and 8 illustrate the container of FIGS. 5 and 6 after it has been filled with a pressurized fluid such as, for example, a carbonated beverage generally indicated by the reference numeral 40'. The pressurized fluid 40' is typically filled to a fill line 41'.

Upon pressurization of the container, the center section 30' tends to assume a right cylindrical shape as is readily apparent from viewing FIG. 8. The flat panels 32' of the unpressurized container as illustrated clearly in FIG. 6, assume a curved cross-section and the decidedly angular configuration between the panels 32' tends to disappear again as illustrated in FIG. 8.

When the ultimate user finally loosens the closure 14' allowing the container to assume the unpressurized state, the container assumes the condition and physical configuration of FIGS. 5 and 6. It is in such unpressurized condition that the container returns to the more rigid condition.

While the embodiments of the invention illustrated in the drawings discloses the use of a footed base configuration, it will be appreciated that other base configurations could be employed without departing from the invention herein set forth.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A plastic container having an upper section including a neck portion, a closed base section, and a central section interconnecting the upper section and the base section, the central section comprising a plurality of juxtaposed reinforcing flat panels, each one of said flat panels being connected to its adjacent said panels to form a polygonal cross sectional shape, said panels being formed of a plastic material having outwardly deformable elastic characteristics, said panels together tending to substantially deform outwardly to a substantially circular cylindrical shape when the container is pressurized, and said upper and base sections tending to remain substantially undeformed and tending to substantially retain their configurations when the container is pressurized.

2. The plastic container according to claim 1, wherein the upper section includes a plurality of juxtaposed flutes extending generally downwardly toward the central section.

3. The plastic container according to claim 1, wherein the base section includes a plurality of juxtaposed flutes extending generally upwardly toward the central section.

4. The plastic container according to claim 1, wherein the upper section includes a plurality of juxtaposed flutes extending generally downwardly toward the central section, and the base section includes a plurality of juxtaposed flutes extending generally upwardly toward the central section, said flutes in the upper section being equal in number to said flutes in the base section.

5. The plastic container according to claim 4, wherein the flat panels in the central section are equal in number to the flutes in the upper section and the base section.

6. The plastic container according to claim 4, wherein the flutes in the upper section are aligned with the flutes in the base section.

7. The plastic container according to claim 4, wherein the flat panels in the central section are aligned with the flutes in the upper section and the base section.

8. The plastic container according to claim 1, wherein the base section includes generally radially arrayed contoured foot portions.

* * * * *